US008540083B2

(12) United States Patent
Waksul

(10) Patent No.: US 8,540,083 B2
(45) Date of Patent: Sep. 24, 2013

(54) PLATE STAND FOR RANDOM ASSORTMENT OF PLATES

(76) Inventor: Isaac Waksul, Long Beach, CA (US)

( * ) Notice: Subject to any disclaimer, the term of this patent is extended or adjusted under 35 U.S.C. 154(b) by 217 days.

(21) Appl. No.: 13/065,175

(22) Filed: Mar. 16, 2011

(65) Prior Publication Data

US 2011/0240574 A1 Oct. 6, 2011

Related U.S. Application Data

(60) Provisional application No. 61/341,874, filed on Apr. 6, 2010.

(51) Int. Cl.
*A47G 19/08* (2006.01)
*A47J 47/16* (2006.01)

(52) U.S. Cl.
USPC ..... 211/41.2; 211/71.01; 248/174; 294/143; 294/161

(58) Field of Classification Search
USPC ..... 211/41.1, 41.2, 41.6, 41.7, 60.1, 211/62, 64, 65, 66, 69.1, 70.1, 70.2, 70.3, 211/70.5, 70.7, 70.8, 71.01, 72, 73, 85.18, 211/85.7, 126.15, 132.1, 133.4, 196, 205, 211/207; 248/146, 150, 152, 174, 460; 294/143, 161; D6/460, 469; 108/101
See application file for complete search history.

(56) References Cited

U.S. PATENT DOCUMENTS

| | | | | |
|---|---|---|---|---|
| 15,255 | A | 6/1874 | Collins | |
| 481,404 | A * | 8/1892 | Jesser | 211/133.1 |
| 563,562 | A * | 7/1896 | Burns | 211/71.01 |
| 601,753 | A * | 4/1898 | Kaiser | 211/41.2 |
| 953,007 | A * | 3/1910 | Haller | 211/71.01 |
| 995,120 | A | 6/1911 | Cooper | |
| 1,091,026 | A * | 3/1914 | Traugot | 211/69.4 |
| 1,093,450 | A | 4/1914 | McLaughlin | |
| 1,334,545 | A * | 3/1920 | Londelius, Jr. | 248/68.1 |
| D75,828 | S * | 7/1928 | Canfield | D6/468 |
| 2,051,093 | A | 8/1936 | Nathan | |
| 2,087,375 | A * | 7/1937 | Ehrhardt | 294/161 |
| 2,313,620 | A * | 3/1943 | Brunner | 211/70.1 |
| D164,503 | S * | 9/1951 | Kerr | D3/259 |
| D176,818 | S * | 1/1956 | Robinson | D6/460 |
| 2,905,332 | A | 9/1959 | Myers | |
| 2,946,452 | A * | 7/1960 | Caloiero et al. | 211/4 |
| 3,039,618 | A * | 6/1962 | Gabriel | 211/132.1 |
| 3,040,881 | A * | 6/1962 | McNeill | 211/85.1 |
| 3,288,304 | A * | 11/1966 | Graves | 211/64 |
| D218,616 | S * | 9/1970 | Owen | D6/468 |
| 3,655,063 | A * | 4/1972 | Landry | 211/41.2 |
| 3,825,216 | A | 7/1974 | Rodvien | |
| 4,330,065 | A | 5/1982 | Haddad | |
| 4,338,866 | A | 7/1982 | Streit | |

(Continued)

*Primary Examiner* — Joshua Rodden
(74) *Attorney, Agent, or Firm* — Curtis L. Harrington; Harrington & Harrington

(57) ABSTRACT

An interlocking assembly of two generally rectangular panels with one of each of their edges aligned proximately to each other at a generally orthogonal engagement, each of the panels including a plurality of matching recess cut-outs in the adjacent edges in which dishes can be engaged in a cantilevered manner. Each of the cut-outs is shaped to include a convex curvature in its lower edge which is opposed by a spaced, generally matching convolution in the upper edge to serve respectively as a large diameter fulcrum to cooperate with an off-set periphery engaging opposing surface between which the dish is captured. To insure a conforming capture the cut-out edges may be covered with a resilient covering.

13 Claims, 3 Drawing Sheets

(56) References Cited

U.S. PATENT DOCUMENTS

| | | | | | |
|---|---|---|---|---|---|
| 4,618,115 | A | | 10/1986 | Belokin, Jr. | |
| 4,787,522 | A | | 11/1988 | Nocek et al. | |
| 4,911,308 | A | | 3/1990 | Nylund | |
| D319,361 | S | * | 8/1991 | Moser | D6/468 |
| 5,064,236 | A | | 11/1991 | Stanfield | |
| 5,088,605 | A | | 2/1992 | Nales | |
| D329,563 | S | * | 9/1992 | Rasmussen | D6/552 |
| 5,195,642 | A | | 3/1993 | Dardashti | |
| 5,301,819 | A | | 4/1994 | Moeken | |
| 5,450,967 | A | * | 9/1995 | Mallory | 211/30 |
| D362,776 | S | * | 10/1995 | Thorn | D6/552 |
| 5,538,145 | A | | 7/1996 | Held | |
| 5,542,731 | A | * | 8/1996 | Wills | 294/161 |
| 5,836,458 | A | | 11/1998 | Nales | |
| D405,300 | S | * | 2/1999 | Regan | D6/473 |
| 5,944,200 | A | | 8/1999 | Nales | |
| 6,070,743 | A | | 6/2000 | Hsueh | |
| 6,269,961 | B1 | | 8/2001 | Porcelli | |
| 6,749,208 | B2 | | 6/2004 | Orozco et al. | |
| D543,078 | S | * | 5/2007 | Davalos | D7/701 |
| 7,520,550 | B2 | | 4/2009 | Lord | |
| D601,841 | S | * | 10/2009 | Neufeld | D6/570 |
| D651,025 | S | * | 12/2011 | Roth et al. | D6/474 |
| 8,186,524 | B2 | * | 5/2012 | Siahpush | 211/196 |
| 2004/0159759 | A1 | * | 8/2004 | Schultz | 248/316.2 |
| 2008/0237169 | A1 | | 10/2008 | May | |
| 2009/0195005 | A1 | | 8/2009 | Lord | |

* cited by examiner

PLATE STAND FOR RANDOM ASSORTMENT OF PLATES

REFERENCE TO RELATED APPLICATIONS

This application obtains the benefit of the earlier filing date of Provisional Patent Application No. 61/341,874 filed on Apr. 6, 2010.

BACKGROUND OF THE INVENTION

1. Field of the Invention

The present invention relates to dish carriers, and more particularly to an interlocking panel assembly conformed to support arrays of dishes both in the course of their delivery and as a stationary support.

2. Description of the Prior Art

Those engaged in preparing and serving food for consumption by others have consistently faced the burdens an array of dishes entails, particularly when more than one person is being served a full meal at a dining table. In commercial settings this burdensome task has been partly assisted by large carrying trays that were then placed either on any adjacent vacant table, or more frequently, on collapsible stands temporarily erected next to the table being served. The manipulative difficulty of a large tray on its fully loaded path from the kitchen has nonetheless become legendary, even providing endless comedic sequences in many of our films, and various mechanical alternatives were therefore devised to assist the overburdened food service provider.

These earlier assisting mechanical alternatives fall generally into three groupings of dish carrier assemblies that also serve as a stand, the first arranged as a cage within which the dishes are suspended by their edges or arranged as a stack, exemplified by the teachings of U.S. Pat. Nos. 5,064,236 to Stanfield; 5,542,731 to Wills; and others; the second in which dish supporting trays, supports or shelves are cantilevered from a common axis that is provided with a support base, as in U.S. Pat. Nos. 953,007 to Haller; 4,911,308 to Nylund; 6,749,208 to Orozco et el.; and others; and the third in which the peripheral edge of each dish is captured in a cantilevered manner within exteriorly directed notch structures around a common carrying axis that also serves as a support base, as in U.S. Pat. Nos. 5,088,605, 5,836,458 and 5,944,200 all to Nales; U.S. Pat. No. 7,520,550 and US publication 2009/0195005 to and by Lord; and many others.

Each of the foregoing, while suitable for the purposes intended, either entails a complex, costly and often cumbersome structure, as exemplified by those in the first two groupings, or the simpler, but more precariously suspended and therefore difficult to manipulate, carrying arrangement in which the engaged dish peripheries are relied on to carry the whole plate loading. Both these modalities are particularly bothersome in a busy restaurant setting and a simply constructed dish carrying arrangement that obtains the benefits and deployment convenience of the cantilevering dish edge capture, but in a more stable and redundant form, is therefore extensively desired and it is one such arrangement that is disclosed herein.

SUMMARY OF THE INVENTION

Accordingly, it is the general purpose and object of the present invention to provide a simply assembled dish carrying structure in which the carried food laden dishes are resiliently retained in cantilevered engagement at varying levels of insertion.

Other objects of the invention are to provide a dish carrying assembly which is easily separated into conveniently stored panels.

Yet further and additional objects of the invention shall become apparent upon the examination of the description that follows in conjunction with the illustrations appended hereto.

Briefly, these and other objects are accomplished within the present invention by providing a pair of generally similar orthogonally interlocking structures each defined as a vertically elongate rectangular panel provided at the top and bottom edges with corresponding co-planar upper and lower lateral extensions each notched by opposingly aligned transverse grooves conformed for crossed mating receipt within each other. Once thus interlocked the resulting crossed structural combination then provides the necessary three dimensional engagement which can either serve as a stand or as a carrying assembly which may be facilitated by forming a handle in the panel that is provided with the upwardly open interlocking grooves.

The panel edges between the lateral extensions are each provided with matching cut-outs each covered with a resilient edge covering and each shaped so that in their crossing interlocked combination conformingly matched edge recesses are provided in which correspondingly shaped peripheral portions of dishes are receivable for a resiliently effected cantilever moment capture of the dish. In this manner various dish shapes may conveniently accommodated by the simple expedient of the cut-out shape, reducing fabrication costs and the need for specialized inventory. Of course, the planar nature of the two main components of this inventive assembly, and also their similar planforms, provide both manufacturing and great storage convenience when not in use.

Thus an easily disassembled and easily stored structural combination is obtained which can be rendered in any convenient material form and which, by the shaping convenience of the edge capturing recesses, can include multiple geometric shapings of the capturing edges to accommodate various dish forms so that inadvertent dropping of the dishes received therein are minimized.

BRIEF DESCRIPTION OF THE DRAWINGS

FIG.. 1 is a perspective illustration of a first embodiment of the inventive dish carrying structural assembly in its interlocked and deployed form;

FIG.. 2 is a perspective illustration of a first embodiment of the inventive dish carrying structural assembly shown in FIG.. 1 separated by its parts;

Figure 2:
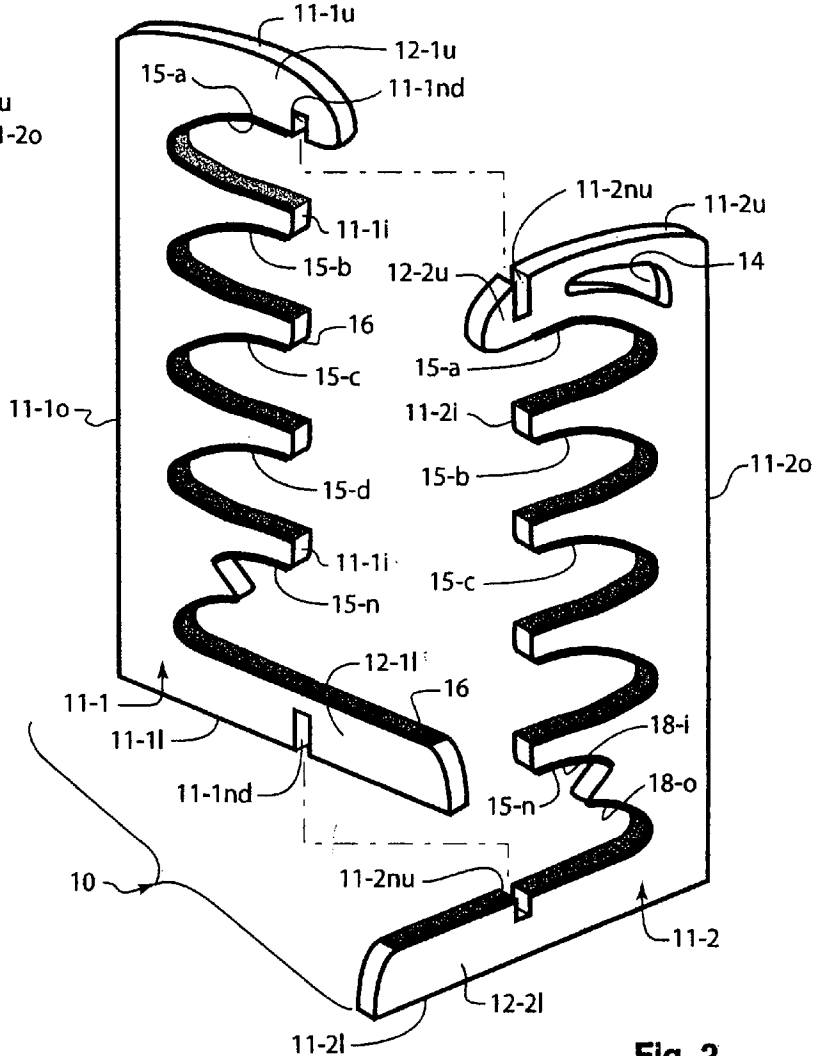
Figure 1:
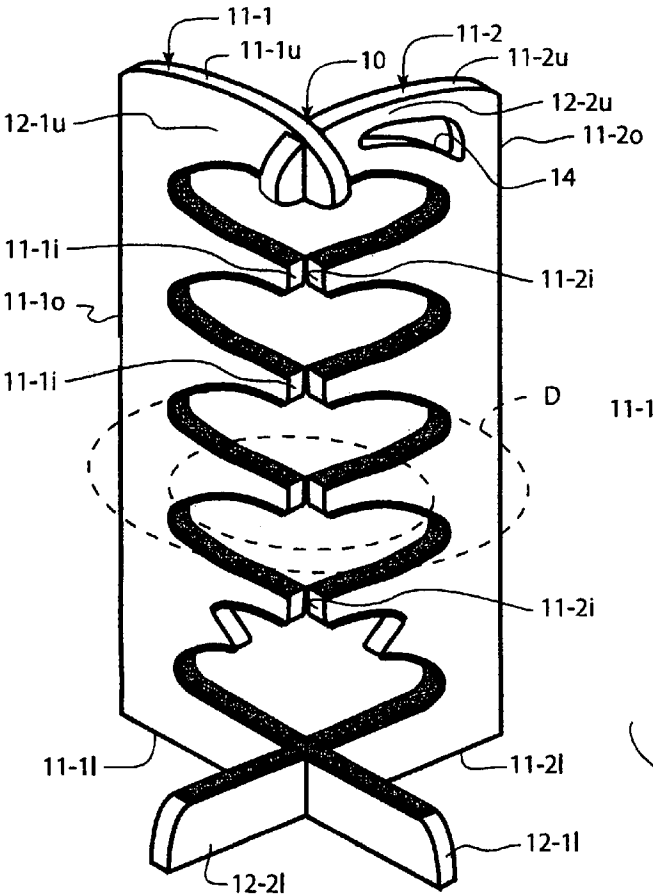
Figure 4:
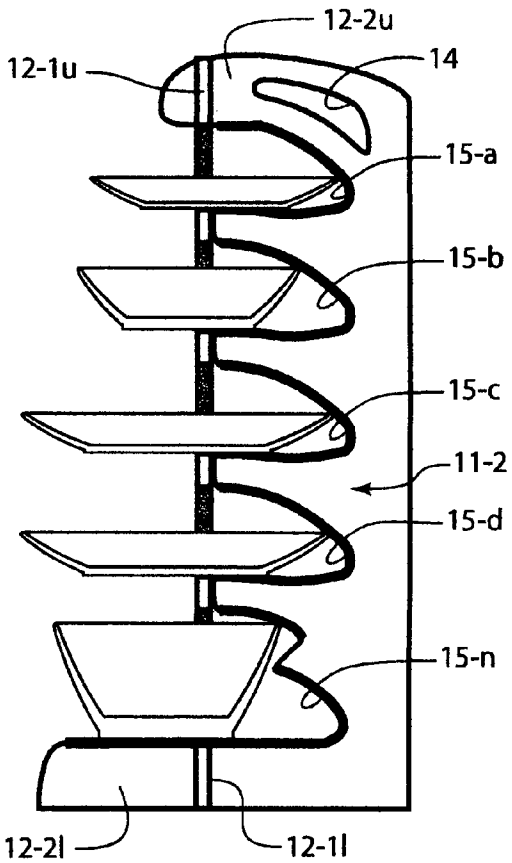
Figure 3:
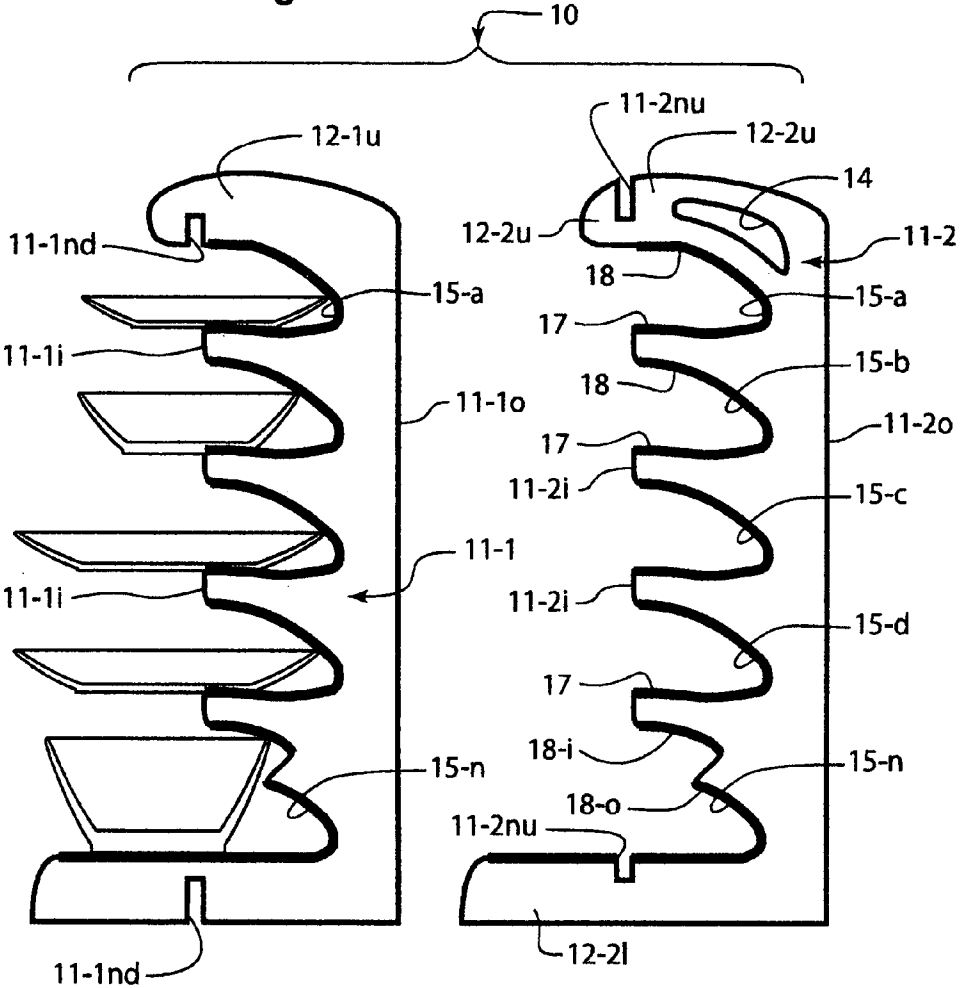
Figure 5:
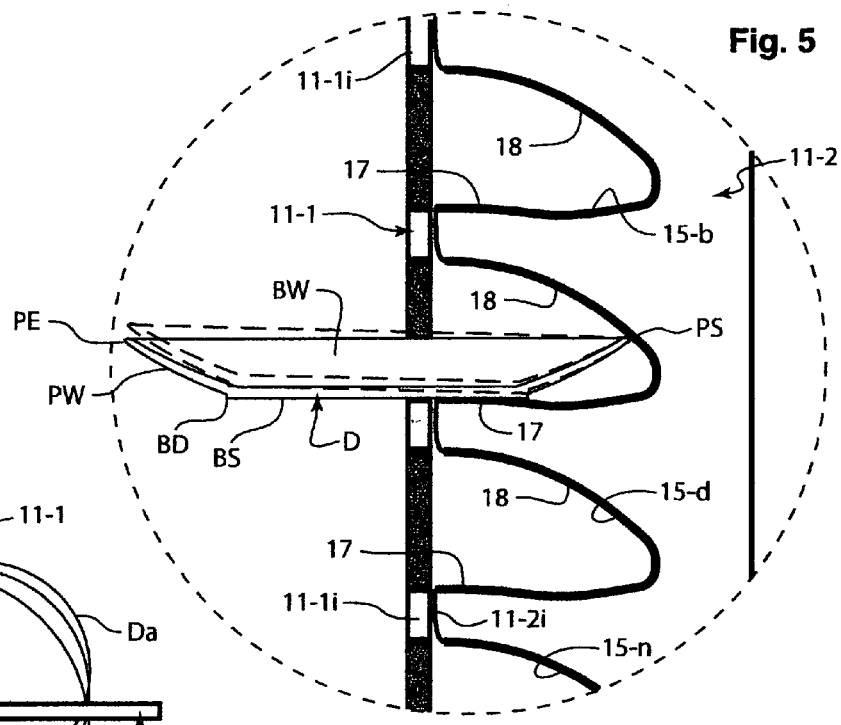

FIG.. 3 is a plan view, again separated by parts, of the inventive dish carrying structural assembly shown in FIG.. 1;

FIG.. 4 is a side view of the inventive dish carrying structural assembly shown in FIG.. 2;

FIG.. 5 is a side view detail of one portion of the inventive dish carrying shown in FIG.S. 1-4;

FIG.. 6 is a diagrammatic top view illustrating the various dish alignments in various cantilevered captures rendered possible within the capturing recesses provided within the inventive dish carrier structural assembly; and FIG.. 7 is yet another side view, separated by parts, of an alternative embodiment of the inventive dish supporting structural assembly.

DESCRIPTION OF THE PREFERRED EMBODIMENTS

As shown in FIG.S. 1-5 the inventive dish carrier assembly, generally designated by the numeral 10, comprises a pair of substantially similar generally planar panels which by their substantial similarity shall be designated herein by the trailing numerals 1 and 2, where the respective panels 11-1 and 11-2 are each of an elongate, generally rectangular planform respectively defined by inner and outer longitudinal edges 11-1*i* and 11-1*o* and 11-2*i* and 11-2*o*. Transversely an upper and a lower edge 11-1*u* and 11-11 and 11-2*u* and 11-2*l* limit the planform of the respective panels 11-1 and 11-2, each of the upper and lower edges extending beyond the corresponding inner edges 11-1*i* and 11-2*i* to continue as the exterior edges of corresponding upper and a lower planar extensions 12-1*u* and 12-11 and 12-2*u* and 12-2*l*, with the lower extensions 12-1*l* and 12-2*l* on each panel being greater in width and spanning further from the corresponding inner edges 11-1*i* and 11-2*i* than the upper extensions 12-1*u* and 12-2*u*.

To effect an interlock between the panels the interior edge of the upper extensions of panel 11-1, immediately proximate its inner edge 11-1*i*, is transversely notched by an downwardly open notch 11-1*nd* with a conformingly similar, but upwardly directed, transverse notch 11-2*nu* formed in the corresponding upper edge 11-2*u* of panel 11-2 with a similar, opposingly directed, set of conforming notches 11-2*nu* and 11-l*nd* formed in the lower inner edge of the extension 12-11 and the lower extension 12-21. These last opposing notches, and also the corresponding extensions in which they are formed, are each somewhat deeper, and correspondingly also wider in their planform, in order to simplify and render convenient their sequential engagement to interlock the panels 11-1 and 11-2 in a crossed relationship.

In this interlocked configuration the inner edges 11-l*i* and 11-2*i* align in a closely adjacent, but substantially orthogonal, relationship with the crosswise engaged lower extensions 12-11 and 12-21 forming a supporting base for this interlocked panel combination. A handle 14 formed in the upper extension 12-2*u* of panel 11-2 is then useful to lift the engaged panel combination from ground to serve as a conveniently assembled, and also conveniently disassembled and stored, carrier structure for dishes D that are suspended in cantilever from a set of matching panel recesses 15-*a* through 15-*n* that are formed in each of the panels in the form of mutually aligned cut-outs from the inner edges 11-l*i* and 11-2*i* into the corresponding panel and to assure a secure cantilevered engagement a resilient strip 16, such as an adhesively attachable foam rubber strip, is applied to each of the edges of the recesses 15-*a* through 15-*n*.

Those skilled in the art will appreciate that the foregoing structure is directed for use in settings where a large number of dishes need to be handled. Of course, such settings rarely involve dishes that are each an 'object d'art', i.e., a precious, extremely fragile artistic piece, but dishes D that are appropriately designed with correct contemplation for strength of materials, the sanitary aspects of the finish, mass density and the like. Simply, dishes appropriately designed for convenient handling with appropriate attention to notions like scaling laws and commercially expedient materials are those that need the handling assistance disclosed herein. These typically include a fairly large circular base with a well defined base edge circle BD supporting the bowl BW surrounded by a peripheral wall PW which either extends upwardly for those dishes that convey fluid foods or that projects generally radially to form a peripheral surface PS. In virtually all instances, however, there is a well-defined, flat, circular bottom surface BS surrounded by a peripheral edge PE that is either substantially above the bottom surface BS or close to the plane thereof.

These attributes are successfully used to advantage in the edge shaping of each of the recesses 15*a* through 15*n* by providing a convex curvature, or bulge, 17 in the bottom portion of the recess edge with a complementary conforming, but radially further from the inner edges 11-l*i* or 11-2*i*, upper edge convolution 18 that is generally spaced from the convex curvature 17 by a radial and vertical gap similar to the gap between the base surface BS and the peripheral edge PE of the particular dish configuration that is to be received in the recess. Since this geometric relationship provides a generally fixed distance between the fulcrum point supporting the base surface BS on the convex curvature 17 and the opposing contact point between the peripheral edge PE at the complementary convolution 18 in each of the panels 11-1 and 11-2 the resulting cantilevered engagement accommodates substantial misalignments of the dish D while still maintaining moment levels of the cantilevered suspension that is within the material strength capacity of the dish D.

Thus each of the recesses 15*a* through 15*d* can be conformed to accept a particular family of dishes, assuring in each instance a self-correcting shift in the fulcrum contact between the dish bottom surface BS and the curvature 17 which occurs within the recesses in both panels 11-1 and 11-2, compensating for a wide range of misalignments in the handling of the dish. Moreover, where the number of recesses is insufficient for the dish variety used the upper convolution 18 may be segmented as illustrated by the recess 15*n* where a substantially higher inner convolution segment 18-*i* extends partly into the recess to accommodate dishes that have a substantial peripheral wall PW while the remaining outer portion 18-*o* then drops to a closer spacing to accommodate flat dishes characterized by a substantial peripheral edge PE that, of course, requires deeper insertion.

In this manner all sorts of complementing dish conFIG.urations can be easily accommodated in a structure that is inexpensive to produce, easily disassembled and stored and conveniently used. The simple planar nature of all the interlocking components of the present invention assures all the foregoing benefits including the packaging convenience benefit when accompanying a sale of complementing dishes.

Figure 6:
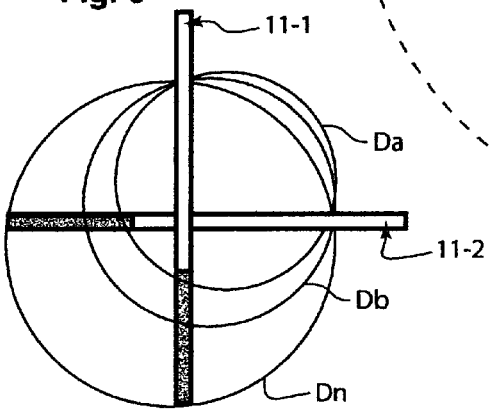
Figure 7:
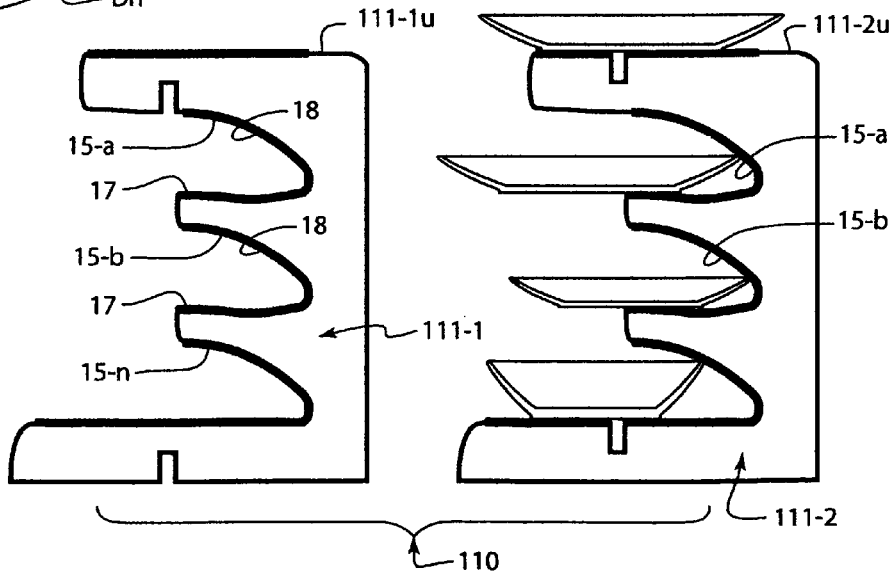

Moreover, as illustrated in FIG. 6 the crossed interlocking of the panels 11-1 and 11-2 results in an accommodating cantilevered capture at various degrees of dish offsets illustrated as Da through Dn. Simply, a well centered positioning of each dish is not required as the capturing engagement can translate both along and across each panel.

While the foregoing conFIG.uration includes the provision of a handle to conform the interlocked combination into a dish carrier, a somewhat simpler implementation illustrated in FIG.. 7 may be conformed to serve only as a dish stand generally designated by the numeral 110 in which panels 111-1 and 111-2 are again interlocked but having the handle omitted. Like numbered parts functioning in a like manner to that previously described panels 111-1 and 111-2 are again defined by inner edges 11-1*i* and 11-2*i* which are each provided with recesses illustrated here as only recesses 15*a* and 15*n* where each are again composed of edge convolutions 18 opposed by the convex curvatures 17. Of course, the previously described interlocking notches and panel extensions are all repeated in this conFIG.uration as is also the convenience of use of the upper edges 111-1*u* and 111-2*u* to support yet another dish, each lower support obtaining the forgiving nature of the cantilevered dish capture also previously described.

Obviously many modifications and variations of the instant invention can be effected without departing from the spirit of the teachings herein. It is therefore intended that the scope of the invention be determined solely by the claims appended hereto.

The invention claimed is:

1. An assembly of a first and second generally rectangular panel each defined by an inner panel edge and an outer panel edge extending between a generally transverse upper and lower panel edge for supporting dishes in a cantilevered manner, each said dish being defined by a generally circular base surface and a periphery spaced from said base surface, said assembly further comprising: a plurality of recess cut-outs extending from into each said first and second panel and along said inner edge of each respective said first and second panel in substantially matching spaced increments therein, each said cut-out being defined by an upper convolution curvature and an opposing lower convex curvature, selected ones of said cut-outs in said first and second panels being conformed for supporting contact between said convex curvature and the base surface and an opposing contact between said convolution curvature and said periphery of a selected one of said dishes; and an upper and lower generally planar extension projecting distally of said inner edges of each said first and second panel adjacent the corresponding upper and lower edges thereof, the upper and lower extensions of said first panel being engageable in a generally transverse engagement to the corresponding ones of said upper and lower extensions of said second panel, and wherein said upper and lower extensions of said first panel each include an associated notch proximate said inner edge and wherein said upper and lower extensions of said second panel each include an associated notch proximate said inner edge and wherein said notches of said upper extensions of said first and second panels oppose each other and engage each other and wherein said notches of said lower extension of said first and second panels oppose each other and engage each other and engage each other to enable said first and second panels to interlock to form a self supported structure.

2. An assembly according to claim 1, wherein each said cut-out includes a resilient cover.

3. An assembly according to claim 2, wherein said convex curvature is laterally offset relative to said convolution curvature.

4. An assembly, according to claim 1, further comprising: a handle formed proximate said upper edge of said second panel.

5. An assembly according to claim 4, wherein said upper convolution curvature and said convex curvature each include a resilient cover.

6. An assembly according to claim 5, wherein said convex curvature is laterally offset relative to said convolution curvature.

7. An assembly comprising:

a first and a second panel each defined by an inner panel edge and an outer panel edge extending between a generally transverse upper and lower panel edge for supporting dishes in a cantilevered manner, each said dish being defined by a generally circular base surface and a periphery spaced from said base surface, a plurality of recess cut-outs extending from said inner edge of each said first and second panel in substantially matching spaced increments therein, each said cut-out being defined by an upper and a lower cut-out edge spaced for opposing contact respectively with the periphery and the bottom surface of a selected one of said dishes, an upper and lower generally planar extension projecting distally of said inner edges of each said first and second panel adjacent the corresponding upper and lower panel edges, the upper and lower extensions of said first panel being engageable in a generally transverse engagement to the corresponding ones of said upper and lower extensions of said second panel, wherein said upper and lower extensions of said first panel each include an associated notch proximate said inner edge and wherein said upper and lower extensions of said second panel each include an associated notch proximate said inner edge and wherein said notches of said upper extensions of said first and second panels oppose each other and engage each other and wherein said notches of said lower extension of said first and second panels oppose each other and engage each other to enable said first and second panels to interlock to form a self supported structure.

8. An assembly according to claim 7, wherein: each said cut-out includes a resilient cover on the edges thereof.

9. An assembly according to claim 8, wherein each said cut-out being defined by an upper convolution curvature and an opposing lower convex curvature and wherein said convex curvature is laterally offset relative to said convolution curvature.

10. An assembly according to claim 7, wherein said upper and lower cut-out edges each include a resilient cover.

11. An assembly, according to claim 7, further comprising: a handle formed proximate said upper edge of said second panel.

12. An assembly of a first and second panel each defined by an inner panel edge and an outer panel edge extending between a generally transverse upper and lower panel edge for supporting dishes in a cantilevered manner, each said dish being defined by a generally circular base surface and a periphery spaced from said base surface, said assembly further comprising: a plurality of recess cut-outs extending from said inner edge of each said first and second panel in substantially matching spaced increments therein, each said cut-out being defined by an upper and a lower cut-out edge spaced for opposing contact respectively with the periphery and the bottom surface of a selected one of said dishes; and an upper and lower generally planar extension projecting distally of said inner edges of each said first and second panel adjacent the corresponding upper and lower panel edges, the upper and lower extensions of said first panel being engageable in a generally transverse engagement to the corresponding ones of said upper and lower extensions of said second panel, wherein said upper and lower extensions of said first panel each include an associated notch proximate said inner edge and wherein said upper and lower extensions of said second panel each include an associated notch proximate said inner edge and wherein said notches of said upper extensions of said first and second panels oppose each other and engage each other and wherein said notches of said lower extension of said first and second panels oppose each other and engage each other to enable said first and second panels to interlock to form a self supported structure.

13. An assembly according to claim 12, wherein said upper and lower cut-out edges each include a resilient cover.

* * * * *